US008948676B2

(12) United States Patent
Fukao

(10) Patent No.: US 8,948,676 B2
(45) **Date of Patent: *Feb. 3, 2015**

(54) IMAGE FORMING APPARATUS

(71) Applicant: Ricoh Company, Ltd., Ohta-ku (JP)

(72) Inventor: Takeshi Fukao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/056,340

(22) Filed: Oct. 17, 2013

(65) Prior Publication Data

US 2014/0044463 A1 Feb. 13, 2014

Related U.S. Application Data

(63) Continuation of application No. 13/177,702, filed on Jul. 7, 2011, now Pat. No. 8,588,643.

(30) Foreign Application Priority Data

Jul. 21, 2010 (JP) ..... 2010-163849

(51) Int. Cl.
*G03G 21/00* (2006.01)
*G03G 15/16* (2006.01)
(Continued)

(52) U.S. Cl.
CPC ..... *G03G 21/005* (2013.01); *G03G 15/161* (2013.01); *G03G 21/12* (2013.01); *G03G 21/105* (2013.01)
USPC ..... 399/343; 399/121; 399/358; 399/360

(58) Field of Classification Search
CPC ... G03G 21/10; G03G 21/105; G03G 21/169; G03G 21/1647; G03G 2215/1647; G03G 2215/1661; G03G 2221/1624; G03G 2221/1642; G03G 2221/1654; G03G 2221/1651
USPC ..... 399/121, 343, 358, 360
See application file for complete search history.

(56) References Cited

U.S. PATENT DOCUMENTS 7,383,001 B2 6/2008 Fukao
8,301,060 B2 * 10/2012 Mori ..... 399/121
(Continued)

FOREIGN PATENT DOCUMENTS

JP 8-314348 11/1996
JP 2002-311773 10/2002
(Continued)

OTHER PUBLICATIONS

Japanese Office Action issued Dec. 17, 2013, in Japan Patent Application No. 2010-163849.

*Primary Examiner* — David Gray
*Assistant Examiner* — Michael Harrison
(74) *Attorney, Agent, or Firm* — Oblon. Spivak, McClelland, Maier & Neustadt, L.L.P.

(57) ABSTRACT

An image forming apparatus includes an image bearing member to bear a toner image, a waste toner storage mechanism to store residual toner, and an intermediate transfer unit detachable from the image forming apparatus. The intermediate transfer unit includes an intermediate transfer member onto which the toner image is transferred, a cleaning device to remove residual toner remaining on the intermediate transfer member after the toner image is transferred to a recording medium, and a connecting mechanism to connect the cleaning device and the waste toner storage mechanism. The connecting mechanism includes a movable connecting tube and a moving device to move the connecting tube between a first position at which the connecting tube engages the cleaning device and the waste toner storage mechanism, and the second position at which the connecting tube separates the cleaning device from the waste toner storage mechanism.

19 Claims, 6 Drawing Sheets

(51) Int. Cl.
*G03G 21/12* (2006.01)
*G03G 21/10* (2006.01)

(56) References Cited

U.S. PATENT DOCUMENTS 8,369,770 B2 * 2/2013 Okamoto et al. ..... 399/360
2010/0046999 A1 * 2/2010 Lee et al. ..... 399/358

FOREIGN PATENT DOCUMENTS

| | | |
|---|---|---|
| JP | 2004-12674 | 1/2004 |
| JP | 2007-155792 | 6/2007 |
| JP | 2009-48112 | 3/2009 |
| JP | 2010-26371 | 2/2010 |

* cited by examiner

IMAGE FORMING APPARATUS

CROSS-REFERENCE TO RELATED APPLICATIONS

This patent application is a continuation application of U.S. Ser. No. 13/177,702, filed Jul. 7, 2011, which claims priority pursuant to 35 U.S.C. §119 from Japanese Patent Application No. 2010-163849, filed on Jul. 21, 2010 in the Japan Patent Office. The contents of the above applications are incorporated herein by reference in their entirety.

BACKGROUND OF THE INVENTION

1. Field of the Invention

Exemplary aspects of the present invention generally relate to an image forming apparatus including an intermediate transfer member on which a toner image is transferred.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

For producing a color image, a tandem-type color image forming apparatus is well known. In the tandem-type image forming apparatus, a plurality of image bearing members, one for each of the colors, for example, black, cyan, magenta, and yellow, is arranged in tandem, and multiple toner images of a respective single color are formed thereon. The toner images are transferred primarily onto an intermediate transfer belt so that they are superimposed one atop the other, thereby forming a composite color toner image. Subsequently, the composite toner image is transferred secondarily from the intermediate transfer belt to a recording medium.

Generally, the tandem-type image forming apparatus is equipped with a cleaning device to remove residual toner remaining on the intermediate transfer belt after the secondary transfer process. The residual toner to be cleaned by the cleaning device contains different colors of toner. Hence, such toner is not returned to a developing device for re-use, but instead, conveyed to a waste toner bin that stores the waste toner and is replaced when full.

In general, such a waste toner bin is provided to either the cleaning device or a main body of the image forming apparatus. Providing the waste toner bin to the main body of the image forming apparatus is advantageous because the main body of the image forming apparatus can provide more capacity for the waste toner bin, thus extending the product life of the waste toner bin.

Typically, the intermediate transfer belt is detachably attached to the image forming apparatus so that the intermediate transfer belt can be replaced or inspected when reaching the end of its product life. Hence, a cleaning device that is provided to the intermediate transfer belt can be detached from the image forming apparatus together with the intermediate transfer belt when detaching the intermediate transfer belt from the image forming apparatus.

Internally, the cleaning device defines a toner conveyance path through which the toner is conveyed. The toner conveyance path of the cleaning device is connected to a toner conveyance path of the main body of the image forming apparatus, to convey the waste toner to the waste toner bin disposed at the main body of the image forming apparatus. Hence, there is demand for simple yet reliable separation and attachment of the toner conveyance path of the cleaning device relative to the toner conveyance path of the main body of the image forming apparatus.

In view of the above, in related-art image forming apparatuses, the direction of separation/installation of the intermediate transfer belt coincides with the direction of separation/attachment of the toner conveyance path of the cleaning device relative to the toner conveyance path of the main body. Furthermore, the toner conveyance path of the cleaning device connects to the toner conveyance path of the main body substantially at a distal end in the direction of installation of the intermediate transfer belt.

In this configuration, installation of the intermediate transfer belt in the main body of the image forming apparatus connects the toner conveyance path of the cleaning device to the toner conveyance path of the main body, thereby forming easily a waste toner conveyance path and hence improving operability.

There is increasing demand for an image forming apparatus without any protruding portions at sides and the back thereof, thereby providing greater flexibility in installation in an office or the like. In one approach, a known image forming apparatus allows maintenance and replacement of devices to be performed from the front or a proximal end thereof so that even when the image forming apparatus is surrounded by walls, such operation can still be performed from the front.

Although advantageous, in the image forming apparatus in which the toner conveyance path of the cleaning device connects to the toner conveyance path of the main body at the downstream side in the direction of installation of the intermediate transfer belt into the image forming apparatus, the waste toner bin is disposed at the distal end or in the interior of the image forming apparatus, complicating access thereto.

To overcome this difficulty, in order to dispose the waste toner bin at the proximal side in the image forming apparatus, in one approach, the waste toner conveyance path extends horizontally from the back to the front of the image forming apparatus. However, such a configuration generally costs more and requires even more space.

For the reasons described above, it is difficult to improve installation or removal of the intermediate transfer belt while simultaneously achieving flexibility in arrangement of the waste toner conveyance path and the waste toner bin

SUMMARY OF THE INVENTION

In view of the foregoing, in one illustrative embodiment of the present invention, an image forming apparatus includes an image bearing member, an intermediate transfer unit, a cleaning device, a waste toner storage mechanism, and a connecting mechanism. The image bearing member bears a toner image. The intermediate transfer unit is removably installable in the image forming apparatus and disposed opposite the image bearing member, including an intermediate transfer member onto which the toner image is transferred. The cleaning device provided to the intermediate transfer unit is disposed opposite the intermediate transfer member and removes residual toner remaining on the intermediate transfer member after the toner image is transferred from the intermediate transfer member onto a recording medium. The waste toner storage mechanism is provided to the image forming apparatus to store the residual toner removed by the cleaning device. The connecting mechanism is provided to the intermediate transfer unit to connect the cleaning device and the waste toner storage mechanism. The connecting mechanism includes a connecting tube movable between a first position and a second position and a moving device to move the connecting tube between the first position and the second position. The connecting tube engages the cleaning device and the waste toner storage mechanism at the first position, and separates the cleaning device from the waste toner storage mechanism at the second position.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
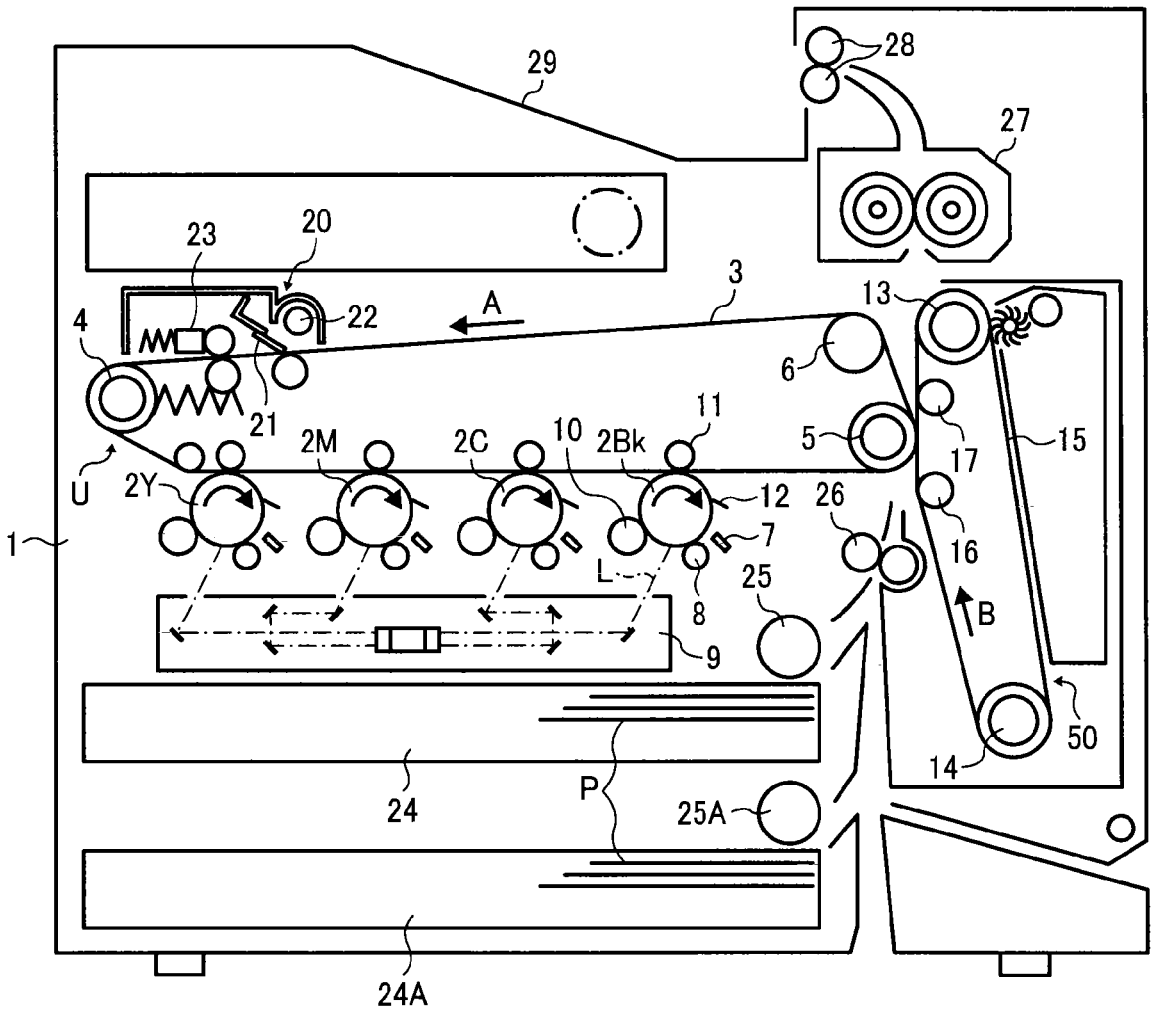
FIG. 1 is a schematic cross-sectional view of an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating the image forming apparatus. The image forming apparatus is a tandem-type image forming apparatus using an intermediate transfer method. In a main body 1 of the image forming apparatus, a plurality of image bearing members (for example, photoconductive drums) 2Y, 2M, 2C, and 2Bk, one for each of the colors yellow, magenta, cyan, and black, are arranged in tandem facing an intermediate transfer belt 3, and multiple toner images of a respective single color are formed thereon.

It is to be noted that the suffixes Y, M, C, and Bk denote colors yellow, magenta, cyan, and black, respectively. To simplify the description, these suffixes Y, M, C, and Bk indicating colors are omitted herein, unless otherwise specified.

The intermediate transfer belt 3 formed into a loop is wound around a plurality of support rollers 4, 5, and 6, and rotated in a direction indicated by an arrow A. The image bearing members 2Y, 2M, 2C, and 2Bk contact the surface of the intermediate transfer belt 3. The toner images on the image bearing members 2Y, 2M, 2C, and 2Bk are transferred onto the intermediate transfer belt 3 so that they are superimposed one atop the other, thereby forming a composite toner image.

The intermediate transfer belt 3 includes multiple layers including a base layer covered by a coating layer. The base layer is formed of, for example, less elastic fluorocarbon resin, a polyvinylidene fluoride sheet, polyimide resin, or the like. The coating layer is formed of material that provides good slidability, such as fluorocarbon resin. Alternatively, the intermediate transfer belt 3 includes a single layer formed of fluorocarbon resin.

Substantially the same configuration is employed for forming and transferring the toner images of yellow, magenta, cyan, and black, differing only in the color of toner employed. Therefore, a description is provided of forming and transferring the toner image of yellow from the image bearing member 2Y onto the intermediate transfer belt 3 as a representative example.

The image bearing member 2Y is rotated in a clockwise direction indicated by an arrow in FIG. 1. While rotating, the surface of the image bearing member 2Y is scanned with light by a charge neutralizer 7, thereby initializing the electric potential of the surface of the image bearing member 2Y. A charging device 8 uniformly charges the initialized surface of the image bearing member 2Y at a predetermined polarity.

Subsequently, the charged surface of the image bearing member 2Y is scanned with a modulated light beam L projected from an exposure device 9 based on image information, thereby forming an electrostatic latent image on the surface of the image bearing member 2Y. According to the illustrative embodiment, a roller-type charging device is employed as the charging device 8. Alternatively, a charging device including a corona discharge device and a blade-type charging device may be used.

According to the illustrative embodiment, the exposure device 9 includes a laser writing device to project the light beam L. Alternatively, the exposure device 9 may include an LED array and an imaging device.

As the electrostatic latent image formed on the image bearing member 2Y passes through a developing device 10, the electrostatic latent image is developed with yellow toner, thereby forming a visible image, also known as a toner image, of the color yellow.

A transfer roller 11 serving as a primary transfer device is disposed inside the loop formed by the intermediate transfer belt 3, opposite the image bearing member 2Y via the intermediate transfer belt 3. The transfer roller 11 contacts the inner surface of the intermediate transfer belt 3, thereby forming a transfer nip between the image bearing member 2Y and the intermediate transfer belt 3.

The transfer roller 11 is supplied with a transfer voltage opposite the polarity of the toner of the toner image on the image bearing member 2Y. Accordingly, a transfer electric field is formed between the image bearing member 2Y and the intermediate transfer belt 3, thereby electrostatically transferring the toner image from the image bearing member 2Y onto the intermediate transfer belt 3 rotating synchronously with the image bearing member 2Y. As described above, the transfer roller 11 or the primary transfer device transfers electrostatically the toner image on the image bearing member 2Y onto the intermediate transfer belt 3.

After the toner image is transferred from the image bearing member 2Y to the intermediate transfer belt 3, residual toner remaining on the image bearing member 2Y is removed by a cleaning device 12. Similar to the toner image of yellow, the toner images of magenta, cyan, and black are formed on the image bearing members 2M, 2C, and 2Bk, respectively. The developing device disposed opposite the respective image bearing member develops the electrostatic latent image on the image bearing member with toner. The toner images of magenta, cyan, and black on the image bearing members 2M, 2C, and 2Bk are transferred electrostatically onto the intermediate transfer belt 3 bearing the toner image of yellow so that they are superimposed one atop the other, thereby forming a composite toner image.

A secondary transfer unit 50 that transfers the composite toner image from the intermediate transfer belt 3 to a recording medium is disposed at the right side of the intermediate transfer belt 3. The secondary transfer unit 50 includes a secondary transfer belt 15, and a plurality of rollers 13, 14, 16, and 17. The rollers 13 and 14 are support rollers around which the secondary transfer belt 15 is wound. The secondary transfer belt 15 is rotated synchronously with rotation of the intermediate transfer belt 3 in the direction indicated by an arrow B.

Figure 2:
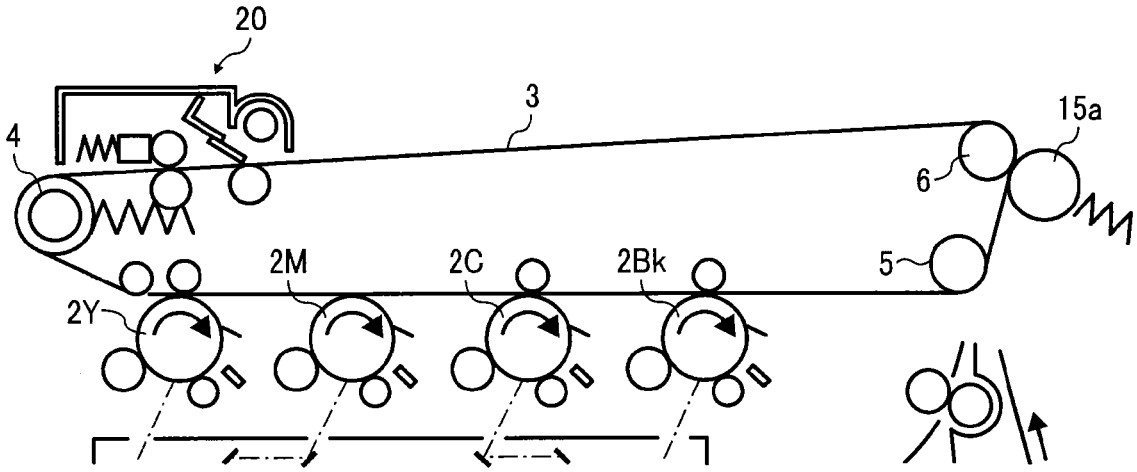
FIG. 2 is a schematic diagram illustrating another example of a secondary transfer unit employed in the image forming apparatus of FIG. 1.

The rollers 16 and 17 are disposed inside the loop formed by the secondary transfer belt 15 such that the portion of the intermediate transfer belt 3 opposite the support roller 5 is between the rollers 16 and 17, and the secondary transfer belt 15 stretched between the rollers 16 and 17 is pressed against the intermediate transfer belt 3. Alternatively, as illustrated in FIG. 2, the secondary transfer unit 50 may include a transfer roller 15*a* disposed opposite the support roller 6 via the intermediate transfer belt 3. FIG. 2 is a schematic diagram illustrating another example of a secondary transfer unit.

The secondary transfer belt 15 is supplied with a transfer voltage opposite the polarity of the composite toner image on the intermediate transfer belt 3, thereby forming a transfer electric field between the intermediate transfer belt 3 and the secondary transfer belt 15. Accordingly, when the composite toner image on the intermediate transfer belt 3 arrives at a transfer position between the intermediate transfer belt 3 and the secondary transfer belt 15, the composite toner image is transferred electrostatically from the intermediate transfer belt 3 onto a recording medium P such as a transfer sheet and a resin sheet. As described above, the secondary transfer unit 50 electrostatically transfers the composite toner image from the intermediate transfer belt 3 onto the recording medium P.

The residual toner and paper dust or the like remaining on the intermediate transfer belt 3 after the composite toner image is transferred onto the recording medium P is removed by a cleaning device 20. As illustrated in FIG. 1, the cleaning device 20 includes a cleaning blade 21, a waste toner conveyance path 22 serving as a first waste toner conveyance path, and a lubricant applicator 23. The cleaning blade 21 scrapes the residual toner adhering to the surface of the intermediate transfer belt 3. The waste toner conveyance path 22 is equipped with a screw to convey the waste toner removed by the cleaning blade 21 to a side portion of the intermediate transfer belt 3. The lubricant applicator 23 applies a lubricant to the surface of the intermediate transfer belt 3 cleaned by the cleaning blade 21.

A sheet feeding unit is disposed substantially at the bottom of the main body of the image forming apparatus. The sheet feeding unit consists of sheet cassettes 24 and 24A, and sheet feed rollers 25 and 25A. The sheet cassettes 24 and 24A store multiple recording media sheets. The sheet feed rollers 25 and 25A each pick up a top sheet of the stack of the recording media sheets in the sheet cassettes 24 and 24A, and send it to a pair of registration rollers 26 via a sheet conveyance path along which a plurality of sheet guides are disposed.

The pair of registration rollers 26 stops temporarily the recording medium P and sends it again to the contact portion between the intermediate transfer belt 3 and the secondary transfer belt 15 in appropriate timing such that the recording medium P is aligned with the composite toner image formed on the intermediate transfer belt 3. The recording medium P sent by the pair of registration rollers 26 passes through the contact portion between the intermediate transfer belt 3 and the secondary transfer belt 15, thereby transferring electrostatically the composite toner image on the intermediate transfer belt 3 onto the recording medium P.

Subsequently, the recording medium P onto which the toner image is transferred is conveyed further up, separating from the secondary transfer belt 15. The recording medium P then passes through a fixing device 27 disposed above the secondary transfer belt 15. Subsequently, the composite toner image transferred onto the recording medium P is fixed onto the recording medium P with heat and pressure, thereby forming a color image on the recording medium P. The recording medium P on which the color image is fixed in the fixing device 27 is discharged onto a sheet discharging portion 29 by a pair of sheet discharge rollers 28. Accordingly, a full-color image is formed on the recording medium P.

The intermediate transfer belt 3 and the multiple support rollers 4, 5, and 6 constitute an intermediate transfer unit U, and the intermediate transfer unit U can be separated from the main body 1 of the image forming apparatus so that the intermediate transfer belt 3 can be replaced or inspected when reaching its product life. According to the illustrative embodiment, the cleaning device 20 is provided to the image forming apparatus so that when the cleaning device 20 reaches its product life, the cleaning device 20 can be separated from the image forming apparatus.

In the main body 1 of the image forming apparatus, the waste toner removed by the cleaning device 20 is conveyed to a waste toner bin, not illustrated, of a waste toner storage mechanism, via a waste toner conveyance path of the waste toner storage mechanism. When the intermediate transfer unit U is installed into or detached from the main body 1, the waste toner conveyance path is connected to or separated from the image forming apparatus side. The waste toner bin and the waste toner conveyance path leading to the waste toner bin constitute the waste toner storage mechanism.

Figure 3:
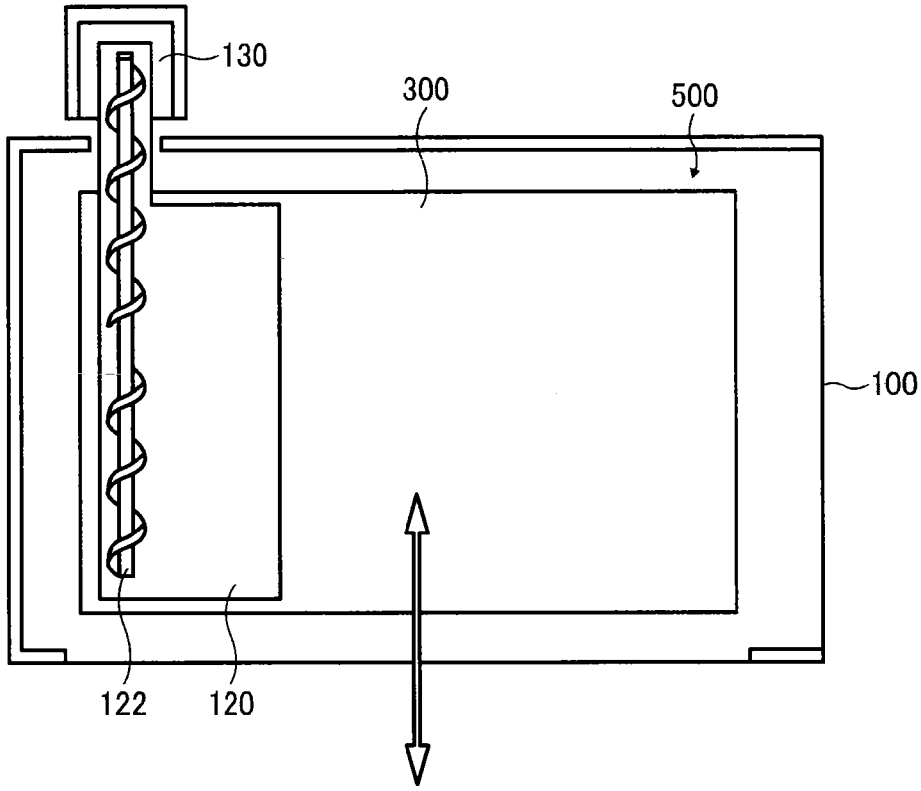
FIG. 3 RELATED ART
FIG. 3 is a plan view of a related-art intermediate transfer unit.

In order to facilitate an understanding of the related art and of the novel features of the present invention, with reference to FIG. 3, a description is now provided of a configuration of a related-art intermediate transfer unit 500 and a waste toner conveyance path 122. FIG. 3 is a plan view of the related-art intermediate transfer unit 500 and the waste toner conveyance path 122. The bottom side of FIG. 3 corresponds to a proximal end, that is, the front side of an image forming apparatus 100. In FIG. 3, an engaging portion 130 connected to or detached from the waste toner conveyance path 122 conveying the waste toner removed by a cleaning device 120 is provided at a distal end portion opposite the proximal end of the main body 100.

As the intermediate transfer unit 500 including an intermediate transfer belt 300 is installed into the main body 100 from the proximal end of the main body 100, the leading end of the waste toner conveyance path 122 of the cleaning device 120 engages the engaging portion 130. By contrast, when the intermediate transfer unit 500 is pulled out or separated from the main body 100, the leading end of the waste toner conveyance path 122 is separated from the engaging portion 130. This configuration is advantageous in that the waste toner conveyance path 122 is connected to or separated from the main body 100 with ease upon installation or separation of the intermediate transfer unit 500 relative to the main body 100. In this configuration, the waste toner bin is disposed at the front side of the main body 100 so that the waste toner bin can be reached easily from the front, hence facilitating replacement of the waste toner bin.

Although advantageous, the waste toner conveyance path 122 needs to be long to connect to the waste toner bin from the engaging portion 130 disposed at the distal end.

Figure 4:
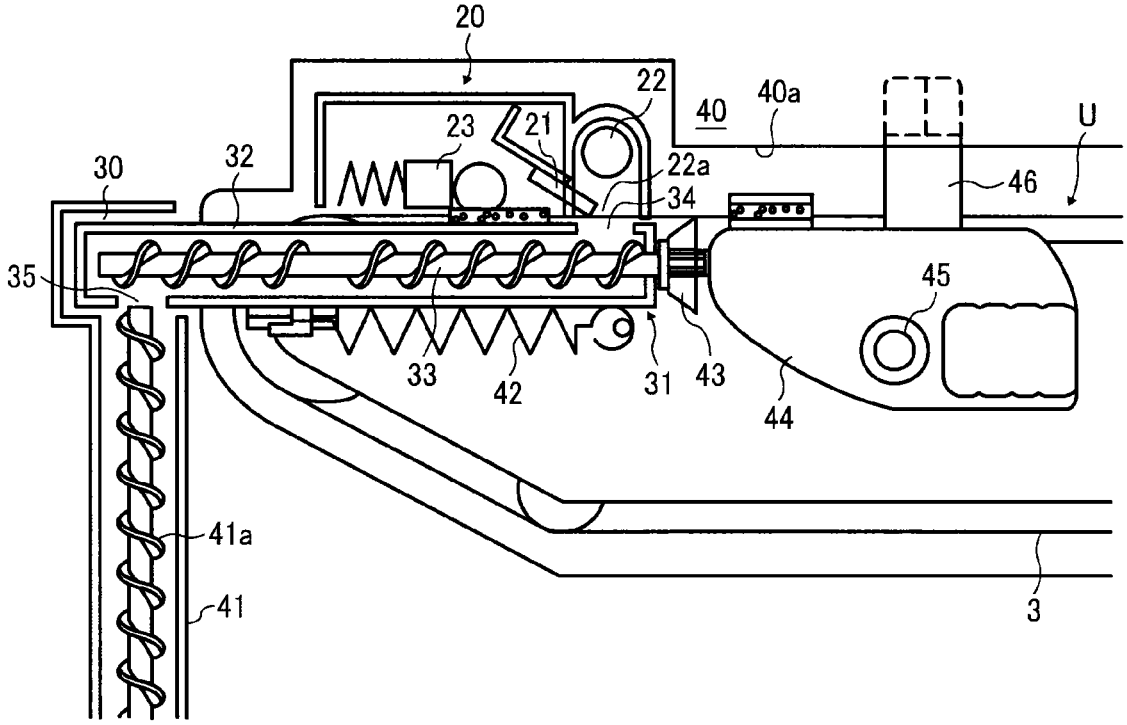
FIG. 4 is an enlarged cross-sectional view partially illustrating a cleaning device for cleaning an intermediate transfer belt, in a state in which an intermediate transfer unit is installed in the image forming apparatus according to an illustrative embodiment of the present invention.

With reference to FIGS. 2 and 4, a description is provided of the cleaning device 20 according to the illustrative embodiment of the present invention. FIG. 4 is an enlarged cross-sectional view of the cleaning device 20.

According to the illustrative embodiment, the intermediate transfer unit U is detachable from an opening 40*a* provided to a front end board 40 at the proximal side of the main body 1 of the image forming apparatus, as illustrated in FIG. 4. More specifically, the intermediate transfer unit U is detachable in a direction perpendicular to a direction of movement of the intermediate transfer belt 3.

In the cleaning device 20, the waste toner conveyance path 22 conveys the waste toner from the distal side of the intermediate transfer belt 3 in the width direction thereof to the proximal side. An intermediate communicating path 31 is disposed at a downstream side of the waste toner conveyance path 22 in the direction of conveyance of the waste toner in the toner conveyance path 22. The intermediate communicating path 31 conveys the waste toner in a direction different from the direction of conveyance of the waste toner in the waste toner conveyance path 22.

According to the present embodiment, the direction of conveyance of the waste toner in the intermediate communicating path 31 corresponds to the direction of movement of the intermediate transfer belt 3. The intermediate communicating path 31 is slidably provided to the intermediate transfer unit U. The intermediate communicating path 31 is slidable in the direction of movement of the intermediate transfer belt 3.

The intermediate communicating path 31 consists of a connecting tube 32 and a conveyance screw 33 disposed inside the connecting tube 32. The connecting tube 32 includes an inlet 34 at the upper right end portion thereof. When the connecting tube 32 engages an engaging portion 30 of the main body 1 of the image forming apparatus, the inlet 34 of the connecting tube 32 communicates an opening 22*a* of the waste toner conveyance path 22 of the cleaning device 20. The connecting tube 32 further includes an outlet 35 at the bottom left end thereof. When the connecting tube 32 engages the engaging portion 30, the outlet 35 communicates a waste toner conveyance path 41 serving as a second waste toner conveyance path of the main body 1.

Although not illustrated, a waste toner bin is disposed substantially at the bottom of the waste toner conveyance path 41. The waste toner may be conveyed from the engaging portion 30 to the waste toner bin under its own weight. According to the illustrative embodiment, however, the waste toner is conveyed using a conveyance screw 41*a* disposed inside the waste toner conveyance path 41.

Figure 5:
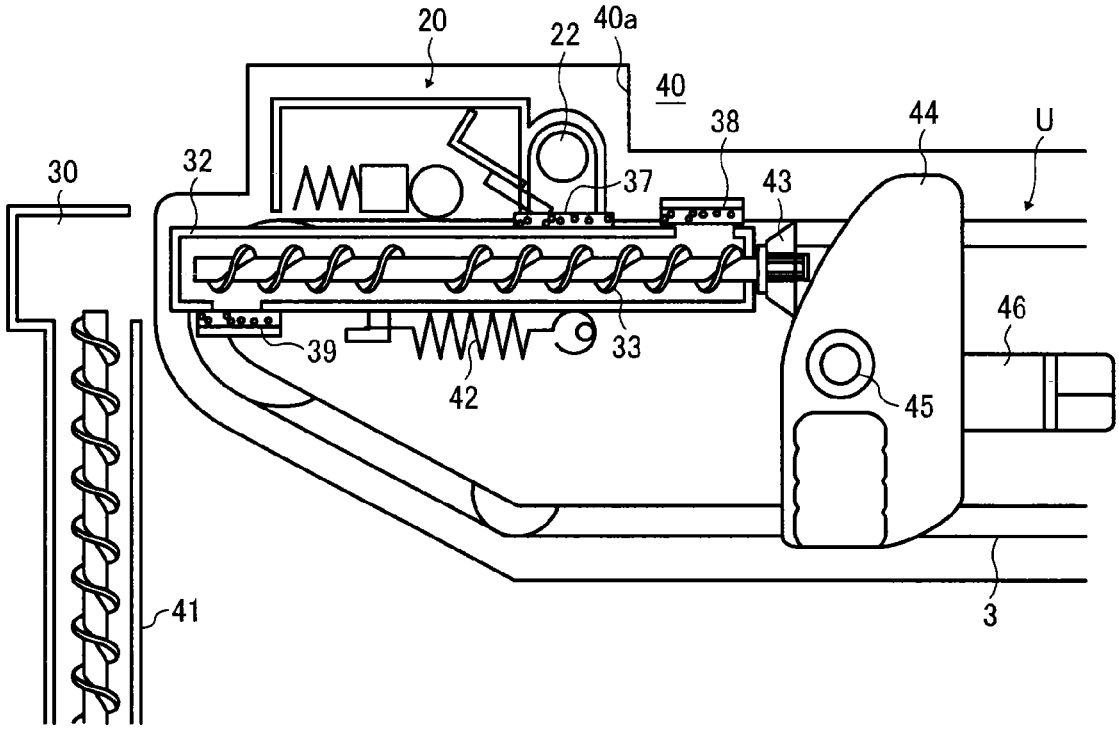
FIG. 5 is an enlarged cross-sectional view partially illustrating the cleaning device of FIG. 4 in a state in which the intermediate transfer unit is separated from the image forming apparatus according to an illustrative embodiment of the present invention.

The intermediate communicating path 31 is movable between an engaging position shown in FIG. 4 and a separating position shown in FIG. 5. More specifically, as illustrated in FIG. 4, during operation, the left end portion of the connecting tube 32 of the intermediate communicating path 31 engages the engaging portion 30 at the engaging position. By contrast, when the left end portion of the connecting tube 32 separates from the engaging portion 30, moving the connecting tube 32 to the separating position as illustrated in FIG. 5, the intermediate transfer unit U becomes detachable from the main body 1 of the image forming apparatus. The connecting tube 32 is biased by a spring 42 such that the connecting tube 32 stays at the separating position.

The intermediate communicating path 31 includes a bevel gear 43 fixed to a shaft of the conveyance screw 33 at the right outside the connecting tube 32. A cam 44 is disposed at the right of the bevel gear 43 to contact the bevel gear 43. The cam 44 is rotatably provided to the intermediate transfer unit U. The cam 44 is rotatable about a shaft 45. A lever 46 is fixed to the cam 44. By moving the lever 46 up, as illustrated in FIG. 4, the cam 44 pushes the connecting tube 32 to the left against the force of the spring 42, thereby moving the connecting tube 32 to the engaging position. By contrast, when the lever 46 is moved to the right from the upright position illustrated in FIG. 4 by 90 degrees as illustrated in FIG. 5, the connecting tube 32 moves to the right, separating from the engaging portion 30. The intermediate communicating path 31 and the cam 44 constitute a connecting mechanism.

Figure 6A:
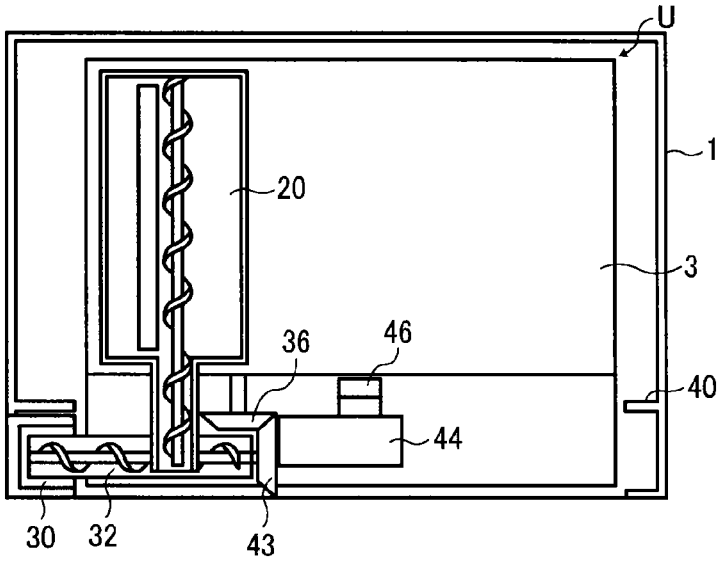
FIGS. 6A through 6C are plan views of the intermediate transfer unit, illustrating steps of separation of the intermediate transfer unit from the image forming apparatus according to an illustrative embodiment of the present invention.
Figure 6B:
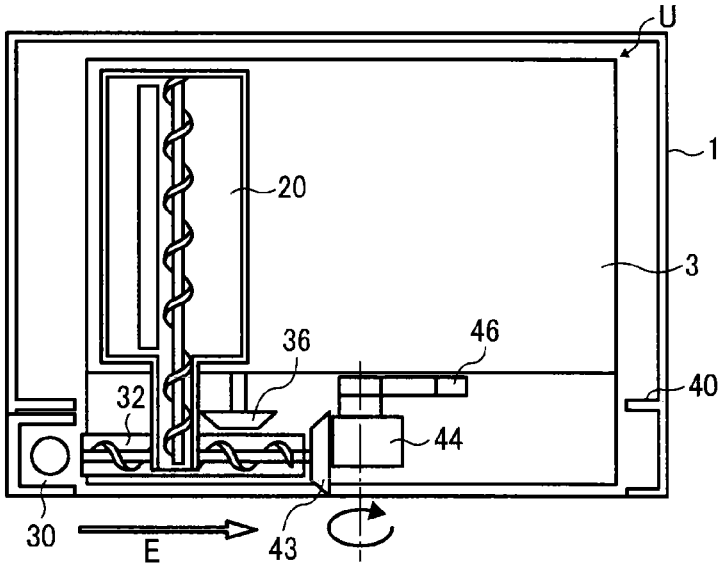
Figure 6C:
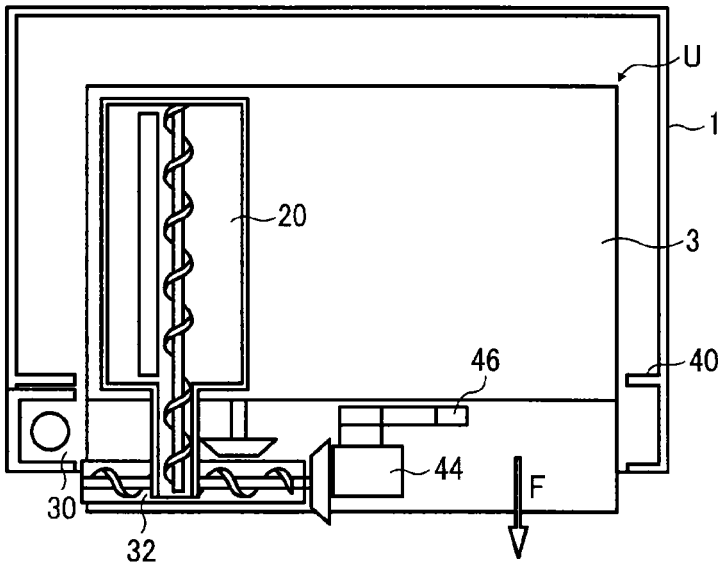

With reference to FIGS. 6A through 6C, a description is provided of steps for moving the intermediate transfer unit U to the front of the main body 1. FIGS. 6A through 6C are plan views of the intermediate transfer unit U, illustrating steps for moving the intermediate transfer unit U according to an illustrative embodiment of the present invention.

When moving the intermediate transfer unit U installed in the main body 1 of the image forming apparatus to the front, the lever 46 in its upright position as illustrated in FIGS. 4 and 6 is rotated approximately by 90 degrees as illustrated in FIG. 5 and FIG. 6B. Accordingly, the connecting tube 32 moves from the engaging position to the separating position in the direction indicated by a hollow arrow E in FIG. 6B, thereby separating the connecting tube 32 from the engaging portion 30 of the waste toner conveyance path 41 and hence moving the intermediate transfer unit U in the direction indicated by a hollow arrow F in FIG. 6C. Accordingly, the intermediate transfer unit U can be taken out from the image forming apparatus.

As illustrated in FIGS. 4 and 6A, when the lever 46 is in the upright position, the upper portion of the lever 46 is in the interior of the front end board 40 including the opening 40*a* of the main body 1. If the intermediate transfer unit U is pulled when the lever 46 is in the upright position, the lever 46 comes into contact with the front end board 40, preventing the intermediate transfer unit U from moving.

When installing the intermediate transfer unit U, the intermediate transfer unit U is installed in the main body 1 in the reverse order. After the intermediate transfer unit U is positioned in place in the image forming apparatus and the connecting tube 32 is moved to the engaging position, engaging the engagement portion 30, the intermediate transfer unit U can be used properly. However, even after the intermediate transfer unit U is properly positioned in the image forming apparatus, it is still possible to forget moving the connecting tube 32 to the engaging portion 30 and start operation. In this case, the conveyance screw 33 rotates undesirably and the toner is pushed into the outlet 35, causing problems such as aggregation and leakage of toner.

Figure 7:
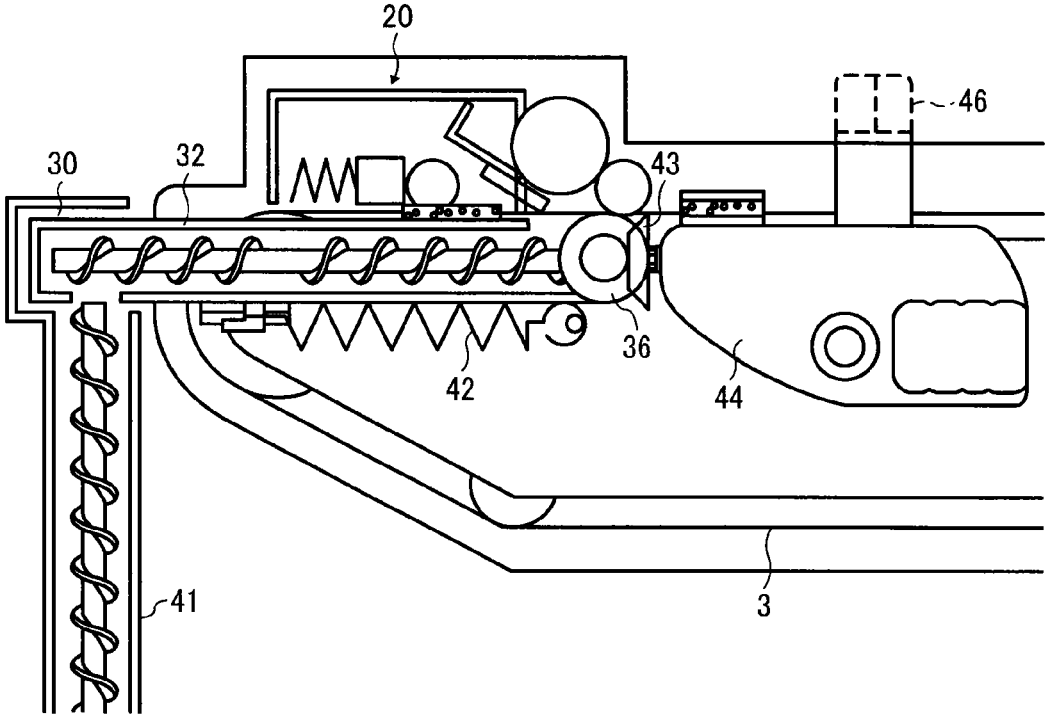
FIG. 7 is a cross-sectional view of a driving system for a waste toner conveyance screw in a state in which the intermediate transfer unit is installed in the image forming apparatus.
Figure 8:
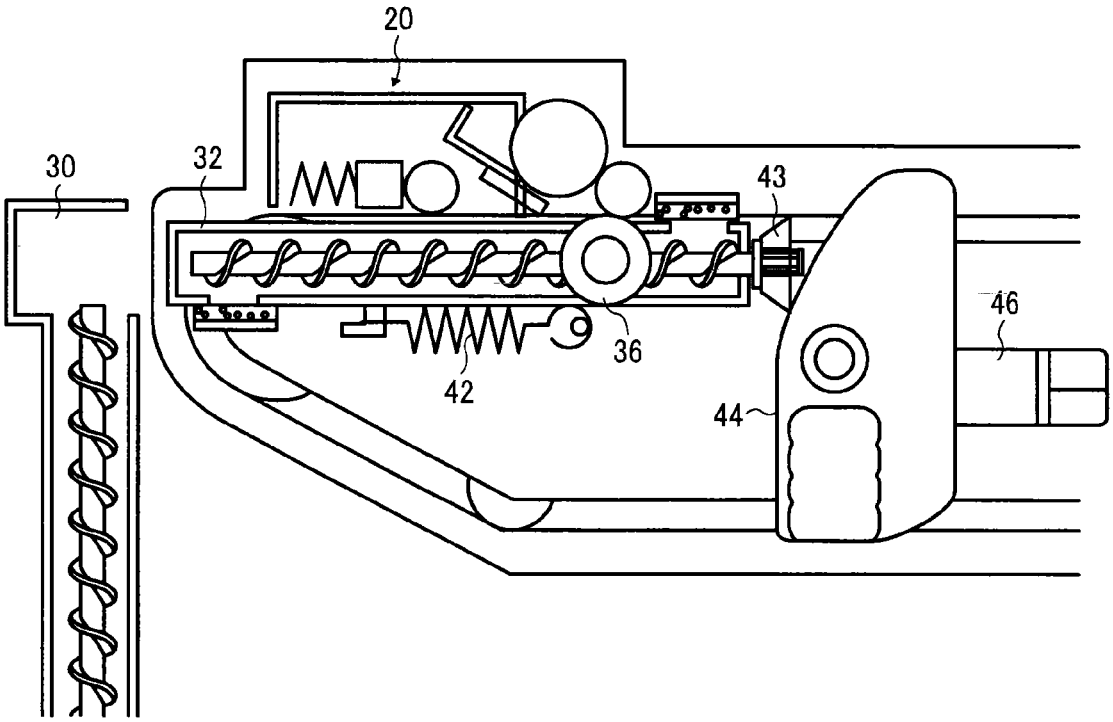
FIG. 8 is a cross-sectional view of the driving system of FIG. 7 in a state in which the intermediate transfer unit is separated from the image forming apparatus.

In view of the above, according to the illustrative embodiment, the bevel gear 43 is driven by engaging a bevel gear 36 which is driven by a drive source of the intermediate transfer unit U as illustrated in FIG. 7. By contrast, when the connecting tube 32 is separated from the engaging portion 30, the bevel gear 43 and the bevel gear 36 are separated, thereby preventing the conveyance screw 33 from rotating.

Furthermore, the intermediate transfer unit U includes a lock mechanism, not illustrated, which locks the intermediate transfer unit U when installed in the main body 1 of the image forming apparatus. The lock mechanism locks and unlocks the intermediate transfer unit U in conjunction with a change in the position of the lever 46 between the engaging position at which the communication tube 32 engages the engaging portion 30 and the separating position at which the connecting tube 32 separates from the engaging portion 30, thereby engaging reliably the connecting tube 32 with the engaging portion 30 without increasing the number of operational steps.

Referring back to FIG. 5, the intermediate transfer unit U includes shutters 37, 38, and 39 to close the opening 22*a* of the cleaning device 20, the inlet 34 and the outlet 35 of the connecting tube 32, respectively according to the illustrative embodiment. When the connecting tube 32 is separated from the engaging portion 30 as illustrated in FIG. 5, the shutters 37, 38, and 39 close the opening 22*a*, the inlet 34, and the outlet 35, respectively, thereby preventing the toner from leaking. The shutters 37, 38, and 39 close the opening 22*a*, the inlet 34, and the outlet 35, as the connecting tube 32 separates from the engaging portion 30. With this configuration, a designated operating mechanism for moving the shutters 37, 38, and 39 is not necessary, thereby achieving a simple configuration.

Figure 9:
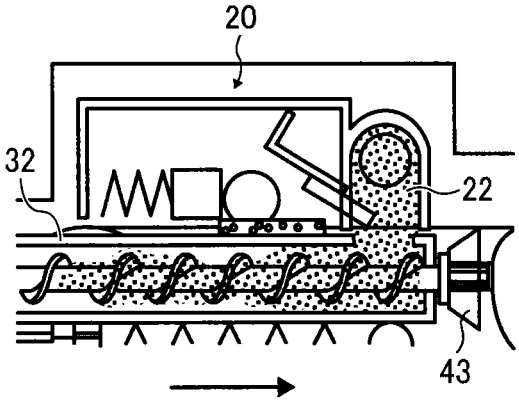
FIG. 9 is a schematic diagram illustrating toner accumulated in the intermediate transfer unit.

As illustrated in FIG. 9, if the toner conveyance path 22 of the cleaning device 20 and/or the connecting tube 32 is filled with the waste toner, the waste toner scatters and local stress is applied to the waste toner causing aggregation of the toner when removing the intermediate transfer unit U. In view of the above, prior to separating the intermediate transfer unit U from the main body 1 of the image forming apparatus, the image forming apparatus performs empty operation without forming an image based on an instruction from a memory, not illustrated, thereby rotating the intermediate transfer belt 3. Furthermore, the waste toner in the waste toner conveyance path 22 of the cleaning device 20 is discharged into the waste toner conveyance path 41 of the main body 1 prior to separating the intermediate transfer unit U from the main body 1.

With this configuration, even when the toner conveyance path 22 of the cleaning device 20 and/or the connecting tube 32 is filled with the waste toner, the waste toner is discharged to the waste toner conveyance path 41 by the time the intermediate transfer unit U is separated from the main body 1. Accordingly, dispersion and aggregation of the toner is prevented.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a toner conveyance path; and a transfer unit detachably attachable relative to the image forming apparatus, the transfer unit including an intermediate transfer belt configured to bear a toner image, a cleaning device configured to remove residual toner remaining on intermediate transfer belt, a connector configured to connect the cleaning device with the toner conveyance path, and a moving device configured to move the connector between a first position and a second position, the connector connecting the cleaning device with the toner conveyance path at the first position, and separating the cleaning device from the toner conveyance path at the second position, wherein the moving device includes a lever to move the connector, the lever being disposed at a front side of the transfer unit with respect to a detaching direction of the transfer unit, and wherein the transfer unit is detachable from the image forming apparatus when the connector is at the second position.

2. The image forming apparatus according to claim 1, wherein the toner conveyance path includes an engaging portion configured to engage with the connector, and wherein the engaging portion prevents the transfer unit from moving in a detaching direction of the transfer unit when the connector is at the first position.

3. The image forming apparatus according to claim 1, wherein the lever is configured to prevent the transfer unit from moving in a detaching direction of the transfer unit.

4. The image forming apparatus according to claim 1, wherein the moving device includes a cam configured to move the connector between the first position and the second position.

5. The image forming apparatus according to claim 1, wherein a direction of movement of the connector between the first position and the second position is different from a detaching direction of the transfer unit.

6. The image forming apparatus according to claim 5, wherein the direction of movement of the connector between the first position and the second position is perpendicular to the detaching direction of the transfer unit.

7. The image forming apparatus according to claim 1, wherein the connector includes an opening and a shutter configured to cover the opening when the connector is at the second position.

8. The image forming apparatus according to claim 1, wherein residual toner remaining in the connector is discharged to toner conveyance path before detaching the transfer unit from the image forming apparatus.

9. The image forming apparatus according to claim 1, further comprising a photoconductive drum on which the toner image is formed, and the toner image is transferred to the intermediate transfer belt from the photoconductive drum.

10. The image forming apparatus according to claim 1, further comprising a spring configured to bias the connector from the first position toward the second position.

11. An image forming apparatus, comprising:

a toner conveyance path; and a transfer unit detachably attachable to the image forming apparatus, the transfer unit including an intermediate transfer belt configured to bear a toner image, a cleaning device configured to remove residual toner remaining on intermediate transfer belt, a connector configured to connect the cleaning device with the toner conveyance path, and a moving device configured to move the connector between a first position and a second position, the connector connecting the cleaning device with the toner conveyance path at the first position, and separating the cleaning device from the toner conveyance path at the second position, wherein the connector includes a conveyance screw configured to convey the residual toner from the cleaning device to the toner conveyance path, rotation of the conveyance screw is prevented when the connector is at the second position, the transfer unit includes a first gear, and the connector includes a second gear configured to engage with the first gear and to rotate the conveyance screw, and the first gear and the second gear are separated when the connector is at the second position.

12. The image forming apparatus according to claim 11, wherein the first gear is a bevel gear.

13. The image forming apparatus according to claim 11, wherein the second gear is a bevel gear.

14. The image forming apparatus according to claim 11, further comprising a photoconductive drum on which the toner image is formed, and wherein the toner image is transferred to the intermediate transfer belt from the photoconductive drum.

15. An image forming apparatus, comprising:

a toner conveyance path;

an intermediate transfer belt configured to bear a toner image;

a cleaning device configured to clean the intermediate transfer belt;

a connector configured to connect the cleaning device with the toner conveyance path; and a moving device configured to move the connector linearly between a first position and a second position in a first direction, wherein the intermediate transfer belt and the connector are detachable from an opening of the image forming apparatus in a second direction different from the first direction when the connector is at the second position, and the connector is disposed at the opening.

16. The image forming apparatus according to claim 15, wherein the toner conveyance path includes an engaging portion configured to engage with the connector when the connector is at the first position.

17. The image forming apparatus according to claim 16, wherein the engaging portion prevents the intermediate transfer belt from detaching from the image forming apparatus when the connector is at the first position.

18. The image forming apparatus according to claim 15, wherein the connector projects outward from the intermediate transfer belt in the first direction when the connector is at the first position.

19. The image forming apparatus according to claim 15, wherein the second direction is perpendicular to the first direction.

* * * * *